US006836081B2

(12) United States Patent
Swanson et al.

(10) Patent No.: US 6,836,081 B2
(45) Date of Patent: Dec. 28, 2004

(54) LED DRIVER CIRCUIT AND METHOD

(75) Inventors: David F. Swanson, Howell, MI (US); James W. Stewart, San Jose, CA (US); Michael K. Lam, San Jose, CA (US); Marcello Criscione, Ragusa (IT)

(73) Assignees: STMicroelectronics, Inc., Carrollton, TX (US); STMicroelectronics Srl (IT); LumiLeds Lighting U.S., LLC, San Jose, CA (US)

( * ) Notice: Subject to any disclaimer, the term of this patent is extended or adjusted under 35 U.S.C. 154(b) by 224 days.

(21) Appl. No.: 09/999,157

(22) Filed: Oct. 31, 2001

(65) Prior Publication Data

US 2003/0025465 A1 Feb. 6, 2003

Related U.S. Application Data

(62) Division of application No. 09/470,900, filed on Dec. 23, 1999, now Pat. No. 6,362,578.

(51) Int. Cl.[7] ..... H05B 37/02

(52) U.S. Cl. ..... 315/307; 315/224; 315/308; 315/309

(58) Field of Search ..... 315/307, 308, 315/224, 129, 247, 209 R, 309; 363/89; 362/800, 543–545

(56) References Cited

U.S. PATENT DOCUMENTS

| | | | | |
|---|---|---|---|---|
| 4,514,727 A | | 4/1985 | Van Antwerp | 340/793 |
| 5,583,402 A | | 12/1996 | Moisin et al. | 315/307 |
| 5,661,645 A | | 8/1997 | Hochstein | 363/89 |
| 5,815,018 A | * | 9/1998 | Soborski | 327/172 |
| 5,856,779 A | | 1/1999 | Friday | 340/479 |
| 5,900,679 A | | 5/1999 | Lake et al. | 307/10.8 |
| 6,150,771 A | | 11/2000 | Perry | 315/291 |
| 6,528,954 B1 | * | 3/2003 | Lys et al. | 315/291 |

* cited by examiner

*Primary Examiner*—Thuy Vinh Tran
(74) *Attorney, Agent, or Firm*—Lisa K. Jorgenson; Christopher F. Regan

(57) ABSTRACT

An LED driver circuit and method are disclosed where a plurality of arrays of light emitting diodes each have a transistor connected to each respective array of light emitting diodes. A PWM controller has an input for receiving a voltage reference and an output connected to selected transistors for driving the selected transistors and setting a PWM duty cycle for the selected arrays of light emitting diodes to determine the brightness of selected light emitting diodes. An oscillator is connected to the PWM controller for driving the PWM controller.

37 Claims, 5 Drawing Sheets

PTMCL temperature profile

Schematic of life cycle test set up

LED DRIVER CIRCUIT AND METHOD

This application is a Div. of U.S. patent Ser. No. 09/470,900 filed Dec. 23, 1999, now U.S. Pat. No. 6,362,578.

FIELD OF THE INVENTION

This invention relates to driver circuits used for light emitting diodes, and more particularly, this invention relates to a driver circuit used for an array of light emitting diodes, such as used in the rear combination lamps of automobiles.

BACKGROUND OF THE INVENTION

Automobiles typically use standard bulbs in the stop-tail-turn combination lamps located at the rear of automobiles. Although sophisticated electronic switching circuits are used to respond quickly to a signal input, such as derived from a brake pedal depression, a normal lamp could still take 250 milliseconds or more to light, which at high speeds could cause 15 to 17 feet of potential error from the time the initial brake pedal was depressed to the time someone viewing the lit lamp has traveled. Additionally, prior art circuits typically were cumbersome in design. It is more desirable to design systems using light emitting diodes that respond quickly and light faster. However, some light emitting diode circuits were complicated when the light emitting diodes were used in the brake-tail-turn combination lamps and other automobile lamps. Much of the prior art circuits have been current controlled where circuits measure the current and respond accordingly in a cumbersome manner. There was also one switch for every array used in the circuit, instead of one switch for an entire plurality of arrays. Additionally, a poor duty cycle and voltage control was provided in those type of systems.

SUMMARY OF THE INVENTION

It is therefore an object of the present invention to provide an LED driver circuit for an array of light emitting diodes that has discrete functionality and provides an efficient duty cycle and voltage control, and single switch circuit.

In accordance with the present invention, an LED drive circuit includes an array of light emitting diodes and a transistor connected to the array. A PWM controller has an input for receiving a voltage reference and an output connected to the transistor for driving the transistor and setting a PWM duty cycle for the light emitting diodes to determine the brightness of light emitting diodes. An oscillator is connected to the PWM controller for driving the PWM controller.

A lamp outage detection circuit is connected to the PWM controller and transistor for determining when a selected number of light emitting diodes are inoperative. The lamp outage detection circuit can comprise a sensing resistor connected to the array of light emitting diodes. An input buffer circuit is connected to the PWM controller and receives voltage signal inputs operative to turn on light emitting diodes based on selected operations such as braking an automobile. The voltage signal inputs, in one aspect of the present invention, can comprise tail, stop and turn signal inputs. A resistor divider circuit provides a reference voltage to the PWM controller. The transistors, PWM controller and oscillator are monolithically formed as one integrated circuit chip. The transistor can comprise field effect transistors. In one aspect, a plurality of arrays having respective transistors are disclosed.

In still another aspect of the present invention, the LED driver circuit comprises a plurality of arrays of light emitting diodes and a transistor connected to each of the respective arrays of light emitting diodes. A PWM controller has an input for receiving a voltage reference and an output connected to selected transistors for driving selected transistors and setting a PWM duty cycle for selected arrays of light emitting diodes for determining brightness of light emitting diodes. A feedback loop circuit is connected to the light emitting diodes and has a switching controller operatively connected to a source of voltage and reference voltage for sensing and regulating a load voltage. An oscillator is connected to the PWM controller and the switching controller for driving the PWM controller and switching controller.

In still another aspect of the present invention, a method is disclosed of driving a plurality of arrays of light emitting diodes and comprises the steps of driving selected transistors connected to each of respective arrays of light emitting diodes by setting a PWM duty cycle within an oscillator driven PWM controller connected to the selected transistors for determining brightness of the light emitting diodes. The method further comprises the step of detecting when a light emitting diode is inoperative by sensing resistors connected to each respective light emitting diode. The method further comprises the step of receiving voltage signals within an input buffer circuit indicative of what combination of arrays of light emitting diodes should be lit.

In still another aspect of the present invention, a method of driving an array of light emitting diodes comprises the steps of driving selected transistors that are connected to respective light emitting diodes by setting a PWM duty cycle within an oscillator driven PWM controller connected to the selected transistors of selected arrays of light emitting diodes to determine brightness of the light emitting diodes, and sensing a regulating load voltage by a switching controller located within a feedback loop circuit of the arrays of light emitting diodes.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention is advantageous because it embodies discrete functionality while implementing an LED array driver. Although the description will proceed with reference specifically to the rear combination lamps (tail, stop and turn signal) of an automobile, the present invention can easily be adapted to encompass front parking and turn signal lamps.

Figure 1:
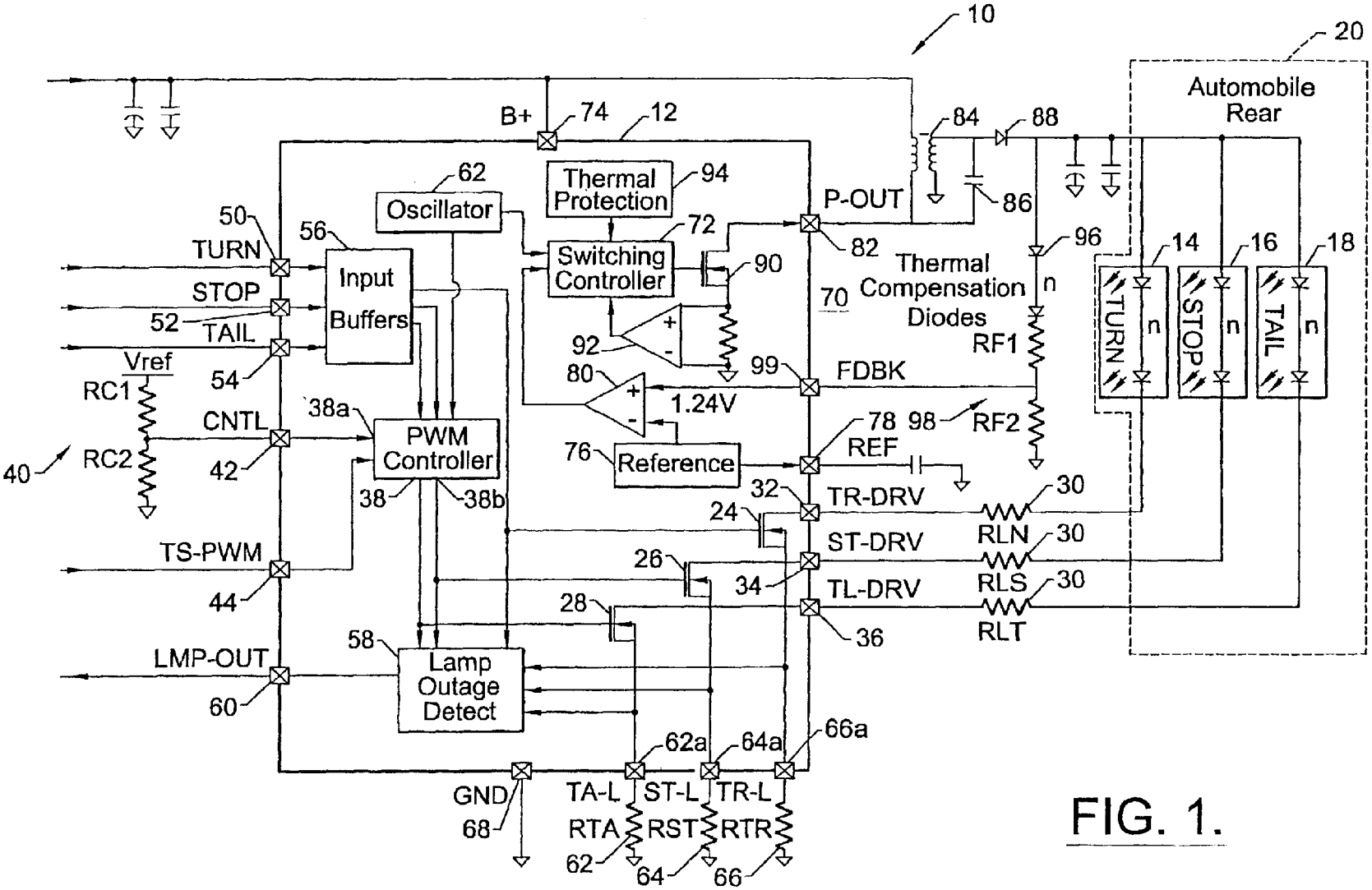
FIG. 1 is a schematic block diagram showing the LED driver circuit of the present invention.
Figure 2:
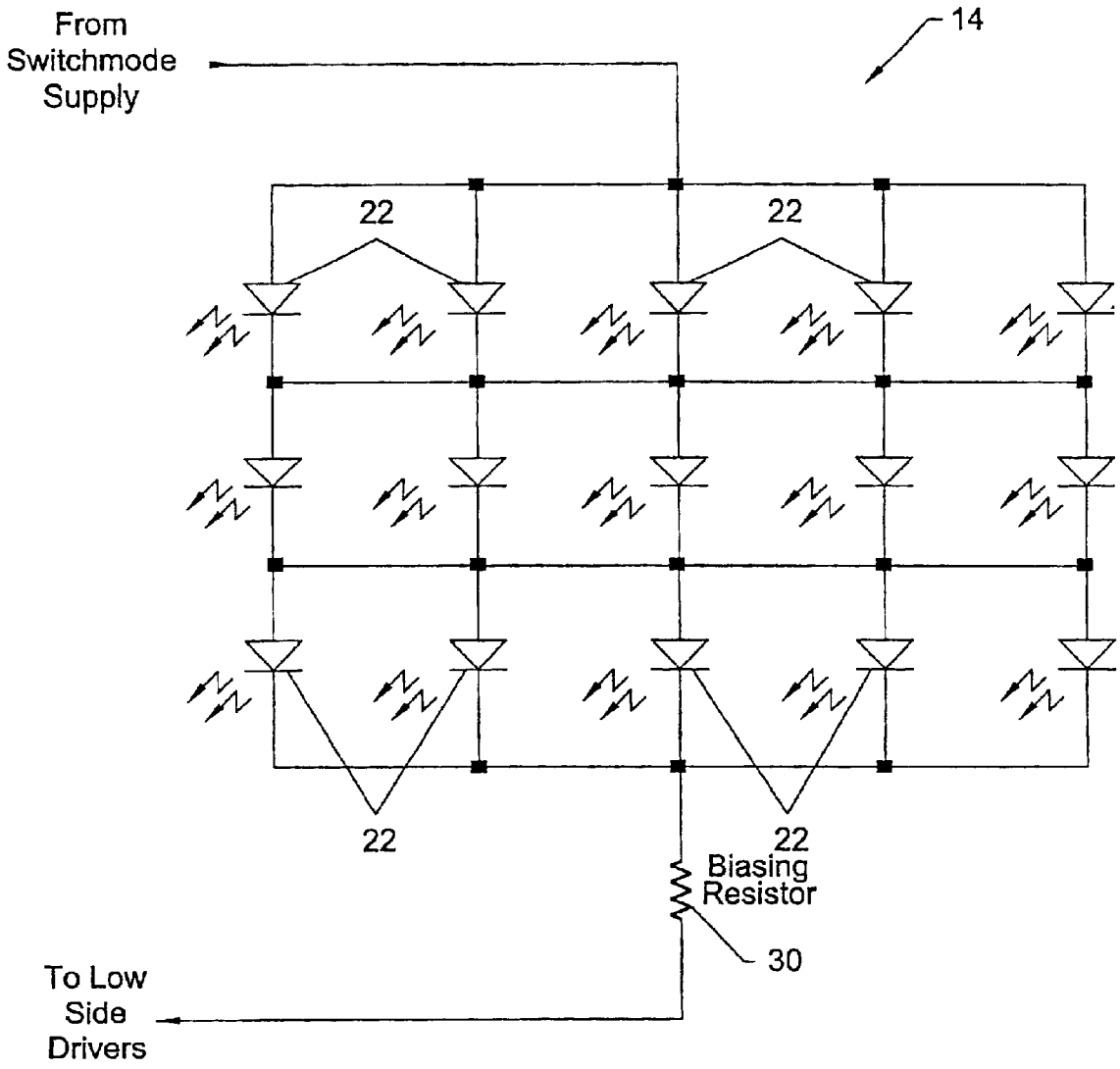
FIG. 2 is an example of an array of light emitting diodes that can be used in the rear combination lamps of an automobile.

FIG. 1 illustrates a schematic block diagram of a monolithically formed LED driver circuit 10 in accordance with the present invention. The integrated circuit portion is shown generally by the rectangular line 12 indicating the integrated circuit that is monolithically formed and having discrete components formed by techniques known to those skilled in the art of semiconductor processing. The monolithic integrated circuit chip having discrete components can form a module that is useful for rapid connection to a wiring harness. A plurality of arrays 14, 16 and 18 of light emitting diodes, such as the turn, stop and tail LED's, are positioned at the rear portion 20 of an automobile. It is also possible to drive the front combination lamps as well, e.g., turn, brake and cornering lamps. An example of an LED array is shown in FIG. 2 where 15 light emitting diodes 22 are connected together in a series and parallel combination.

The drive circuit 10 shown in FIG. 1 includes the arrays 14, 16, 18 of light emitting diodes 22 and a respective transistor 24, 26, 28 in the form of a metal oxide semiconductor field effect transistor (MOSFET) connected to each respective array of light emitting diodes via a biasing resistor 30. The integrated circuit includes the appropriate turn, stop and tail drive pins 32, 34, 36 as shown.

A PWM controller 38 has an input 38*a* for receiving a voltage reference and an output 38*b* connected to selected transistors for driving selected transistors 26, 28 and setting a PWM duty cycle for selected arrays of light emitting diodes to determine the brightness of light emitting diodes. A reference signal is provided by a voltage divider circuit 40 that connects via a control pin 42 to the PWM controller. A TS-PWM pin 44 provides a three-state input that determines the control logic for the PWM controller 38 of the tail and stop LED arrays 16, 18. Naturally, the control pin 42 is used to set the pulse-width-modulation (PWM) frequency in conjunction with voltage provided by the voltage divider circuit 40. Turn, stop and tail input pins 50, 52, 54 are brought high via input signals to activate the integrated circuit and drive and turn or stop the LED array. The pins 50, 52, 54 connect to a signal input buffer 56, which in turn, connects to the PWM controller 38 in the case of the stop and tail signals and to a lamp outage detect circuit 58 in the case of the turn signal. A lamp out pin 60 connects to the lamp out detect circuit 58 and is an active, pull-down signal in fault condition, and a pull-down when there is no fault. An oscillator 62 is connected to the PWM controller 38 for driving the PWM controller.

The lamp outage detect circuit 58 also connects to the respective transistors 24, 26, 28 and the appropriate tail, stop and turn sensing resistors 62, 64, 66 that connect to the transistors and respective current sensing pins 62*a*, 64*a*, 66*a* used to determine a lamp out condition with respective turn, stop and tail LED arrays 14, 16, 18. The drive circuit 10 as a whole is grounded via ground pin 68. A feedback loop circuit 70 is connected to the arrays of light emitting diodes. A switching controller 72 forms part of a switched mode supply and is operatively connected to a source of supply voltage labeled B+ or "battery plus" at pin 74 and a reference voltage supply 76 for sensing and regulating the load voltage. The reference voltage supply 76 connects to the switching controller 72 via a reference pin 78 and a comparator circuit 80. The feedback loop circuit 70 includes a low side P-OUT driver pin 82 for the primary of a switching voltage regulator 84, capacitor 86 and diode 88 and a field effect transistor 90 and comparator circuit 92. A thermal protection circuit 94 connects to the switching controller 72.

A series of thermal compensation diodes 96 are connected in the feedback loop circuit to voltage divider 98 and feedback pin 99 to provide a ramp down of voltage to the light emitting diodes when a predetermined temperature is reached.

The device power shown in FIG. 1 can be driven by a separate supply or can use a diode or'ed supply from either of the three inputs 50, 52, 54, i.e., turn, stop or tail. This configuration makes the system compatible with integrated lighting control modules or existing wiring harnesses that are simple in construction.

The input buffers 56 accept 0V to vehicle battery voltages as inputs. Any of the inputs going high causes the device to power up. For the various configurations, pins can be tied together. For instance, the stop and turn signal inputs 50, 52 can be tied together (or one ignored) when the customer implements the same set of LED's for both functions.

The PWM controller 38 provides the PWM duty cycle for the tail lamp (tail lamp array 18) function. The CNTL pin 42 provides a voltage level into the PWM controller 38 to set the percent duty cycle used for the tail lamp function. Having this function adjustable provides for various application requirements.

The duty cycle calculation for the tail lamp can be incorporated as:

$$\% \ DC = K_1 \frac{V_{REF}(R_{C2})}{R_{C1} + R_{C2}}$$

where:

$$K_1 = TBD\left(\frac{1}{v}\right)$$

A thermal detection circuit formed from diodes 96 is intended to provide protection and work as a shut down circuit for the light emitting diode arrays. The light emitting diode lifetime is greatly reduced at or above 100° C. This circuit provides a ramp down of the supply voltage to the diodes when the 100° C. limit is reached. This greatly increases the lifetime of each diode array. Temperature compensation is arranged by the diodes located in the feedback loop circuit having the switching controller.

The lamp outage detect circuit 58 synchronizes a driver "on" command with the current measured in a driver leg of the field effect transistors. This compensates for any level of a chosen PWM factor. A timer could be added to the circuit to ensure that no false lamp outage indications are detected. The outputs of this circuit can be open collector type of signals. In prior art systems, the only way to detect a lamp outage was to separate the LED's in several sets of series diodes. This prior art system was unreliable and costly. In the present invention, the driven LED arrays are each a matrix array where diodes are connected in parallel and in series. Any sensing of current changes from a single diode outage is difficult and not necessary.

The only time a lamp outage is required to be detected is when the overall lamp no longer functions, i.e., current out of the bulb is outside of requirements. The LED array can have as many as 50% of the array out before there is a need to report that a faulted array is present. The other aspect of the LED in this type of an array is that as LED's burn out, the other LED's could burn out because the LED's carrying the load causing them to be hotter. As they heat up, they tend to fail sooner. Thus, when a few LED's burn out, it will not be long until other LED's burn out, causing more than 50% of the array to fail.

As noted before, to accommodate for the different arrays and applications, a sensing resistor 30 is used for each "lamp" function, STOP, TAIL and TURN. This allows for fairly accurate lamp outage detection without having a false outage reporting. Reporting the failure can occur in a number of ways in accordance with the present invention. A first manner of reporting a failure is ordering the three failure signals together and using a dedicated signal pin 32, 34, 36. Another technique would be to use the inputs themselves as bidirectional pins. By placing a sink current on the respective TAIL, STOP or TURN input, a feedback can be implemented without the need for an additional wire. This only works if the separated B+ supply (as shown) is used. The switching controller circuit 72 in FIG. 1 is a standard sepic converter that senses and regulates the load voltage. The load voltage level can be determined by the comparison of the feedback (FDBK) voltage with the reference (REF) voltage.

The LED drivers are unprotected MOSFETs 24, 26, 28 with an Rds(on) based on the thermal limitations of the system. The limiting resistors $R_{LT}$, $R_{LB}$ and $R_{LN}$ are designed to set the current in the respective LED arrays. These values are specific to the array, which allows for flexibility in lamp configuration. Where the brake and turn signals can be tied together, they can share a common set of LED's.

Table I illustrates an example of possible configurations of the present invention with the appropriate input and output connections.

TABLE I

| Configuration | Input Connection | Output Connection |
|---|---|---|
| Tail, Stop, Turn utilizing separate LED arrays | All inputs separated | All outputs separated |
| Stop & Tail utilizing the same LED array with the Turn LED array separated | All inputs separated | Stop and Tail outputs tied together. Turn separate. |
| Stop, Tail and Turn utilizing same LED's | All inputs separated | All outputs tied together |
| Stop and Turn utilizing the same LED arrays with the Tail LED array separated | Stop and Turn inputs either tied together or only one is used for both | Stop and Turn outputs are tied together or only one is used for both |

Further details of the various pins of the LED drive module integrated circuit are set forth in Table II, followed by a short description of each pin function relative to the circuit operation. There also follows greater details concerning the operation of the circuit and various testing procedures that have been used to verify function of the circuit of the present invention.

TURN: Turn Input Pin

When brought high, TURN activates the IC and drives the turn LED array 14. Turn will be switched on at a typical voltage of about V=0.6 VB, and switched off at a typical voltage of about V=0.4 VB (minimum hysteresis of 10%). Maximum current draw should be about 10 mA.

STOP: Stop Input Pin

When brought high, STOP activates the IC and drives the stop LED array 16. Stop will be switched on at a typical voltage of about V=0.6 VB, and switched off at a typical voltage of about V=0.4 VB (minimum hysteresis of 10%). Maximum current draw should be about 10 mA.

TAIL: Tail Input Pin

When brought high, TAIL activates the IC and drives the tail LED array 18. Tail will be switched on at a typical voltage of about V=0.6 VB, and switched off at a typical voltage of about V=0.4 VB (minimum hysteresis of 10%). Maximum current draw should be about 10 mA.

CNTL: Control Pin

Figure 3:
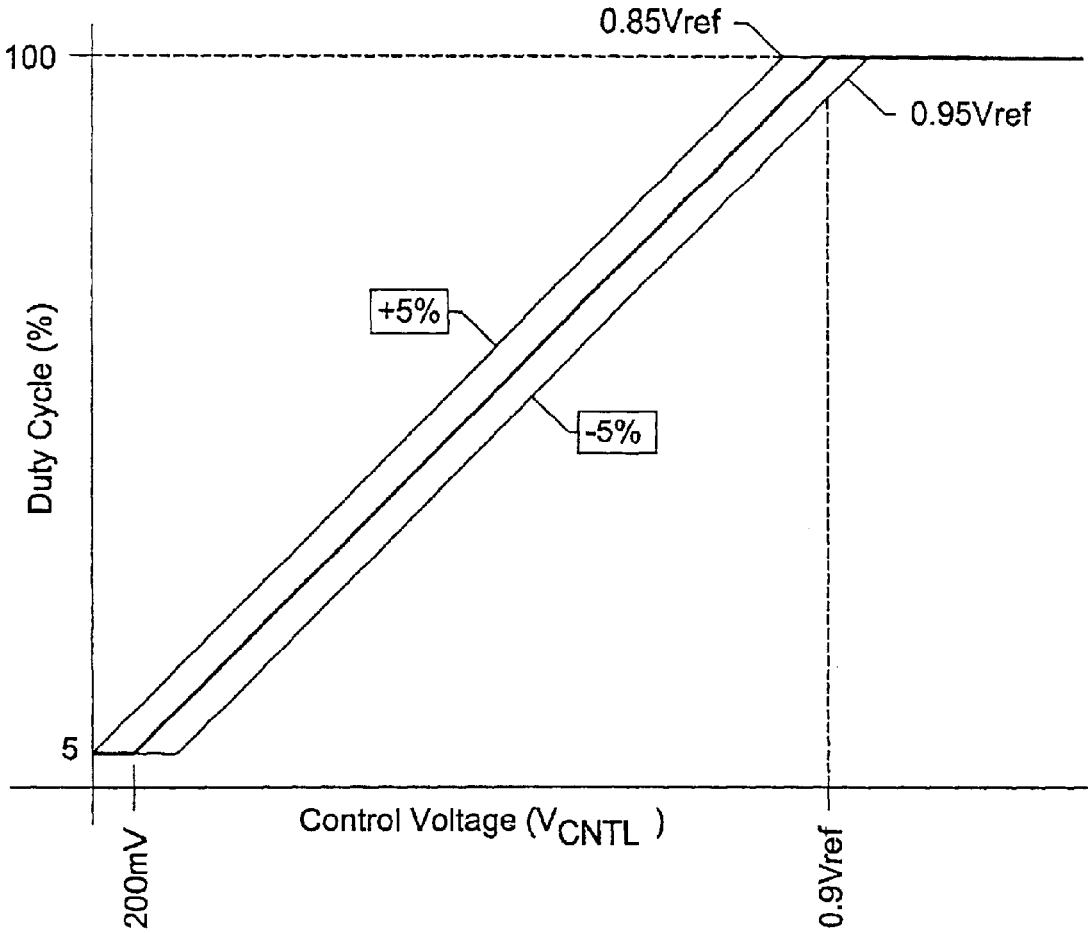
FIG. 3 is a graph showing the relationship between the duty cycle and the control voltage.

The control is used to set the Pulse-Width-Modulation (PWM) DF. Resistors RC1 and RC2 in the voltage divider 40 can be varied to set the PWM DF to $DF_{PWM}$ by the following equation: $DF_{PWM}=K*RC1/(RC1+RC2)$. Duty factor (cycle) vs. the voltage on the control pin ($V_{CNTL}$) is shown in FIG. 3.

TS-PWM: Tail/Stop PWM Control Pin

The tail/stop is used to control which functions (tail, stop, or both) are pulse width modulated when the TAIL pin is actuated. An example of a logic table for this control is shown below in Table II.

TABLE II

LOGIC TABLE FOR TAIL/STOP PWM CONTROL PIN

| Vin TS-PWM Pin | Functions Actuated (Stop/Tail) | Drive of Tail Array | Drive of Stop Array |
|---|---|---|---|
| Low | Tail Only | PWM | PWM |
| ($V<0.1\ V_{REF}$) | Stop Only | OFF | ON |
| | Tail and Stop | PWM | ON |
| Ref | Tail Only | PWM | OFF |
| (V = floating) | Stop Only | OFF | ON |
| | Tail and Stop | PWM | ON |
| High | Tail Only | PWM | PWM |
| ($V>0.9\ V_{REF}$) | Stop Only | ON | ON |
| | Tail and Stop | ON | ON |

LMP-OUT: Lamp-Out Pin

The lamp-out is used to indicate the failure of any individual function (TAIL, STOP, or TURN). A fault will be detected only when the input for that function (TURN, STOP, or TAIL) is brought to $V_B$ and when the voltage at pin TA-L, ST-L, or TR-L drops below some designated level. A failure shall be indicated by bringing the LMP-OUT pin to logic low. Minimum current to be sourced shall be 100 mA.

In addition, the LMP-OUT pin 60 is used to indicate if an RCL of the type known to those skilled in the art is connected to the vehicle's electrical system. This shall be accomplished by having logic high as the normal state of LMP-OUT. While in the logic high state, the LMP-OUT pin can source a minimum of 10 mA, such that if the LMP-OUT functions for two RCL's can be attached in parallel, a failure will be indicated if either lamp fails.

P-OUT: Power Output Pin.

The P-OUT pin is used to drive the switching power supply transformer/inductor to the LED's. P-OUT should be coupled to the LED arrays by the transformer/capacitor (Sepic topology) circuit 84,86 as shown in the block diagram of FIG. 1.

B+ Pin

A positive battery connection pin allows power to be supplied to the circuit.

Although the following details concern various functional requirements and operation of the circuit of the present invention, the specific details can vary as known to those skilled in the art. The following tables are also examples of various conditions, functions and samples that could be used in the present invention.

Figure 4:
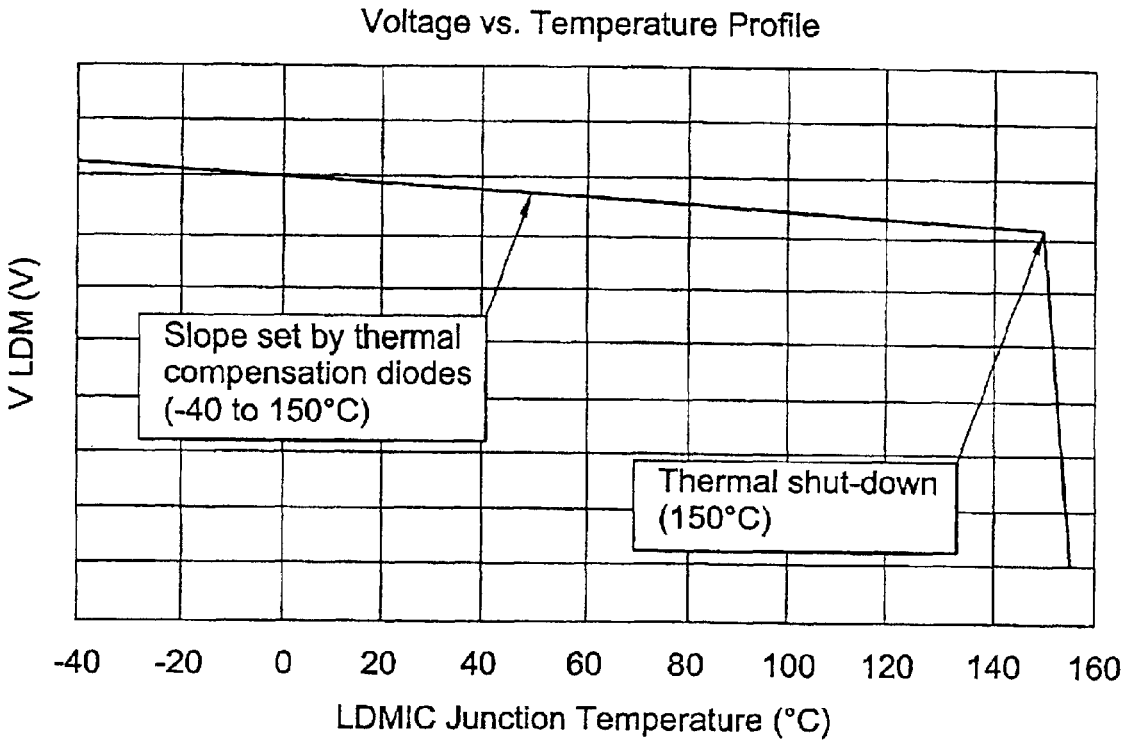
FIG. 4 is a graph showing a voltage versus temperature profile of the LED driver circuit of the present invention.
Figure 5:
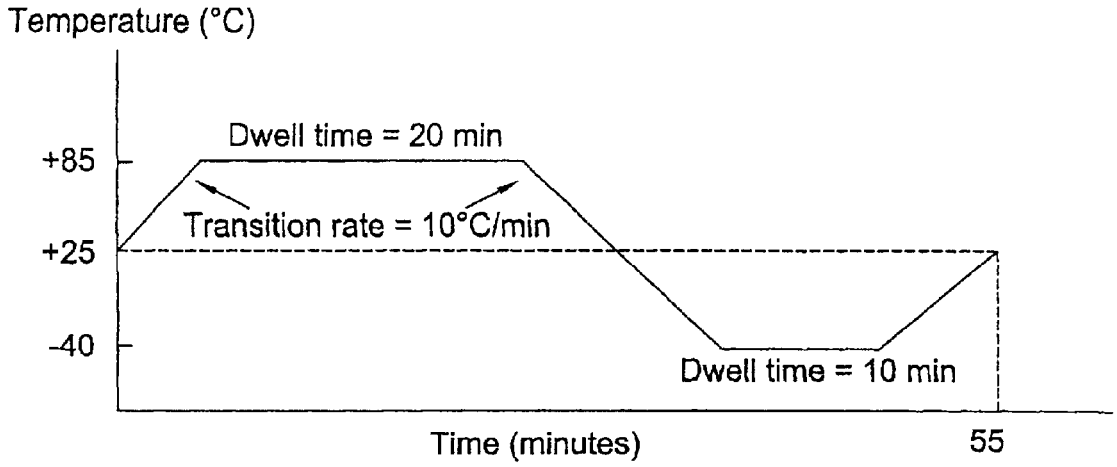
FIG. 5 is a graph showing the temperature profile versus the time of an LED driver circuit of the present invention.
Figure 6:
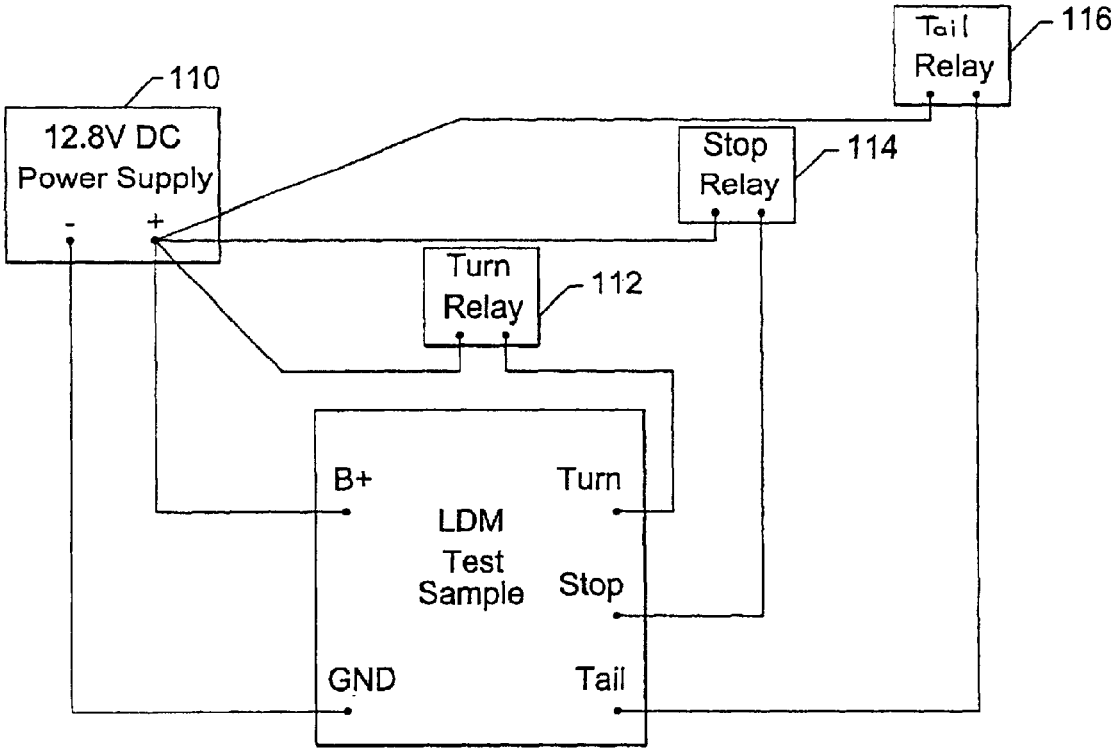
FIG. 6 is a schematic block diagram of LED driver circuit test sample used in the present invention.

To achieve external dimming control of the LED arrays 14, 16, 18, the inputs (TURN, STOP, and TAIL) should be compatible with pulse-width-modulated input having a maximum frequency of 200 Hz, and a minimum DF of 10%. The voltage supplied can vary as a function of temperature as shown in FIG. 4. The transition point should be controlled to about ±20° C.

The driver circuit typically will shut down as abruptly as possible once an internal junction temperature of 150+/−20°

C. has been exceeded. There can be a minimum hysteresis of 10° C., before the device returns to operation to prevent the lamp from flickering when $T_{J\ LDMIC}$@150° C.

Within the range of −40 to 150° C., the device can be designed to supply constant current to the LED arrays. The slope of the curve in this range should be approximately −2 mV/° C. times the number of LED's in series within each array, e.g., for five LEDs in series, the slope should be about −10 mV/° C. The slope of this line can be set by the external, thermal-compensation diodes in the feedback loop circuit as shown in FIG. 1.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An LED driver circuit comprising:

a plurality of arrays formed from light emitting diodes;

a transistor connected to each array of the plurality of arrays formed from light emitting diodes;

a PWM controller having an input for receiving a voltage reference and an output connected to selected transistors and arrays of light emitting diodes for driving the selected transistors and setting a PWM duty cycle for the selected arrays of the light emitting diodes for determining brightness of the light emitting diodes;

a feedback loop circuit connected to said light emitting diodes and having a switching controller operatively connected to a source of voltage and a reference voltage for sensing and regulating a load voltage; and an oscillator connected to the PWM controller and the switching controller for driving the PWM controller.

2. An LED driver according to claim 1, further comprising at least one thermal compensation diode connected within said feedback loop circuit to provide a ramp down of voltage to the selected arrays of light emitting diodes when a predetermined temperature is reached.

3. An LED driver according to claim 2, further comprising a feedback transistor connected within said feedback loop circuit and a comparator operatively connected to said switching controller and said feedback transistor for comparing drive and feedback currents.

4. An LED driver according to claim 1, further comprising a lamp outage detection circuit connected to said PWM controller and said transistors for detecting when a selected number of light emitting diodes are inoperative.

5. An LED driver according to claim 4, wherein said lamp outage detection circuit further comprises a sensing resistor connected to each respective array of light emitting diodes.

6. An LED driver according to claim 1, further comprising an input buffer circuit connected to said PWM controller for receiving voltage signal inputs indicative of a combination of light emitting diodes being lit based on selected operations.

7. An LED driver according to claim 6, wherein said voltage signal inputs comprise tail, stop and turn signal inputs.

8. An LED driver according to claim 1, further comprising a resistor divider circuit for providing a reference voltage to the PWM controller.

9. An LED driver according to claim 1, wherein said transistors connected to the arrays of light emitting diodes, the PWM controller and the oscillator are monolithically formed as one integrated circuit chip.

10. An LED driver according to claim 1, wherein said transistors connected to said arrays of light emitting diodes comprise field effect transistors.

11. An LED driver circuit comprising:

a plurality of arrays of light emitting diodes;

a field effect transistor connected to each array of the plurality of arrays of light emitting diodes;

a PWM controller having an input for receiving a voltage reference and an output connected to selected transistors and arrays of light emitting diodes for driving the selected transistors and setting a PWM duty cycle for the selected arrays of light emitting diodes for determining brightness of the light emitting diodes;

a feedback loop circuit having a switching controller operatively connected to a source of voltage and reference voltage for sensing and regulating a load voltage;

an oscillator connected to the PWM controller and the switching controller for driving the PWM controller; and a lamp outage detection circuit operatively connected to said PWM controller and said field effect transistors for synchronizing an "on" command with a measured current for detecting when a selected number of light emitting diodes are inoperative and compensating for any selected PWM duty cycle.

12. An LED driver according to claim 11, and further comprising at least one thermal compensation diode connected within said feedback loop circuit to provide a ramp down of voltage to the selected arrays of light emitting diodes when a predetermined temperature is reached.

13. An LED driver according to claim 11, further comprising a transistor connected within said feedback loop circuit and a comparator operatively connected to said switching controller and said transistor.

14. An LED driver according to claim 11, wherein said lamp outage detection circuit further comprises a sensing resistor connected to each array of respective light emitting diodes.

15. An LED driver according to claim 11, further comprising an input buffer circuit connected to said PWM controller for receiving voltage signal inputs indicative of a combination of light emitting diodes that being lit based on selected operations.

16. An LED driver according to claim 15, wherein said voltage signal inputs comprise tail, stop and turn signal inputs.

17. An LED driver according to claim 11, further comprising a resistor divider circuit for providing a reference voltage to the PWM controller.

18. An LED driver according to claim 11, wherein said transistors connected to the arrays of light emitting diodes, the PWM controller and the oscillator are monolithically formed as one integrated circuit chip.

19. An LED driver according to claim 11, wherein said transistors connected to said arrays of light emitting diodes comprise field effect transistors.

20. A method of driving an array of light emitting diodes comprising the steps of receiving a voltage reference within a PWM controller and outputting a signal for driving selected transistors connected to respective arrays of light emitting diodes and setting a PWM duty cycle for selected arrays of light emitting diodes to determine brightness of the light emitting diodes, and further comprising a step of receiving voltage signals within an input buffer circuit indicative of what combination of arrays of light emitting diodes should be lit.

21. A method according to claim 20, further comprising a step of detecting when a select number of light emitting diodes are inoperative by sensing resistors connected to each respective light emitting diode.

22. A method of driving an array of light emitting diodes comprising the steps of receiving a voltage reference within a PWM controller and outputting a signal for driving selected transistors that are connected to respective arrays of light emitting diodes and setting a PWM duty cycle for selected arrays of light emitting diodes to determine brightness of the light emitting diodes, and sensing a regulating load voltage by a switching controller located within a feedback loop circuit of the selected arrays of light emitting diodes.

23. A method according to claim 22 further comprising a step of ramping down voltage to the selected arrays of light emitting diodes when a predetermined temperature is reached.

24. A method according to claim 22 further comprising a step of detecting when a select number of light emitting diodes in an array are inoperative by sensing resistors connected to each respective array of light emitting diodes.

25. A method according to claim 22 further comprising a step of receiving voltage signals within an input buffer circuit indicative of what combination of arrays of light emitting diodes being lit.

26. An LED driver circuit comprising:

a plurality of arrays formed from light emitting diodes;

a transistor connected to each array of the plurality of arrays formed from light emitting diodes;

a controller having an input for receiving a voltage reference and an output connected to selected transistors and arrays of light emitting diodes for driving the selected transistors and setting a duty cycle for the selected arrays of light emitting diodes for determining brightness of the light emitting diodes; and a circuit connected to said light emitting diodes and to a source of voltage and a reference voltage for sensing and regulating a load voltage and providing a ramp down voltage to the selected arrays of light emitting diodes when a predetermined temperature is reached.

27. An LED driver according to claim 26, wherein said controller comprises a PWM controller, and including an oscillator connected to said PWM controller for driving said PWM controller.

28. An LED driver according to claim 26, wherein said circuit for sensing and regulating a load voltage comprises a feedback loop circuit.

29. An LED driver according to claim 28, wherein said feedback loop circuit includes a switching controller operatively connected a source of voltage and a reference voltage.

30. An LED driver according to claim 28, and further comprising a thermal compensation diode connected within said feedback loop circuit to provide the ramp down of voltage to the light emitting diodes when a predetermined temperature is reached.

31. An LED driver according to claim 28, further comprising a feedback transistor connected within said feedback loop circuit and a comparator connected to the feedback transistor for comparing drive and feedback currents.

32. An LED driver according to claim 26 further comprising a lamp outage detection circuit connected to said controller and said transistors connected to the arrays of light emitting diodes for detecting when a selected number of light emitting diodes are inoperative.

33. An LED driver according to claim 32, wherein said lamp outage detection circuit further comprises a sensing resistor connected to each respective array of light emitting diodes.

34. An LED driver according to claim 26 further comprising an input buffer circuit connected to said controller for receiving voltage signal inputs indicative of a combination of light emitting diodes being lit based on selected operations.

35. An LED driver according to claim 34, wherein said voltage signal inputs comprise tail, stop and turn signal inputs.

36. An LED driver according to claim 26 further comprising a resistor divider circuit for providing a reference voltage to the controller.

37. An LED driver according to claim 26, wherein said transistors connected to the arrays of light emitting diodes and said controller are monolithically formed as one integrated circuit chip.

* * * * *